United States Patent [19]

Oliver

[11] Patent Number: 4,915,393

[45] Date of Patent: Apr. 10, 1990

[54] CARD GAME METHOD

[75] Inventor: Earl Oliver, Mesa, Ariz.

[73] Assignee: Alfred E. Hall, Dallas, Tex.

[21] Appl. No.: 324,107

[22] Filed: Mar. 16, 1989

Related U.S. Application Data

[63] Continuation of Ser. No. 183,063, Apr. 19, 1988, Pat. No. 4,846,480.

[51] Int. Cl.[4] ..... A63F 1/00
[52] U.S. Cl. ..... 273/292
[58] Field of Search ..... 273/292

[56] References Cited

U.S. PATENT DOCUMENTS

| | | | |
|---|---|---|---|
| 2,026,082 | 12/1935 | Darrow | 273/256 |
| 4,223,892 | 9/1980 | Matherne | 273/248 |
| 4,807,885 | 2/1989 | Chamblee et al. | 273/292 |

*Primary Examiner*—Anton O. Oechsle
*Attorney, Agent, or Firm*—Alfred E. Hall

[57] ABSTRACT

An improved method of playing a card game with a deck of cards having specialty cards that, when played on a penalty card, either transfer the penalty required by the penalty card to the suceeding player, return the penalty required by the penalty card to the preceding player, or cancel the penalty required by the penalty card.

4 Claims, 1 Drawing Sheet

CARD GAME METHOD

This is a continuation of pending application for U.S. Letters Patent Ser. No. 183,063 filed Apr. 19, 1988, now U.S. Pat. No. 4,846,480.

TECHNICAL FIELD

The present invention relates to a method of playing a card game with a card deck having a plurality of cards for successive play by a plurality of players where the cards include at least one penalty card requiring a receiving player to take a predetermined number of cards from a reserve card supply. More particularly, the invention relates to such a method with a card deck having specialty cards that, when played on a penalty card, either transfer the penalty required by the penalty card to the succeeding player, return the penalty required by the penalty card to the preceding player or cancel the penalty required by the penalty card.

BACKGROUND OF THE INVENTION

There are many methods of playing card games with card decks in which, when a penalty card is played by one player, the succeeding player must accept the penalty required by the penalty card. Such a penalty card, for instance, may require the receiving player to take a number of cards from a reserve card pile, thus increasing the number of cards in his hand and making it more difficult for him to be the first player to play all of the cards in his hand.

There are also methods of playing card games in which card decks have cards that reverse the direction of play or skip the succeeding player thus requiring him to miss his turn. Such cards make the deck unpredictable and create a level of excitement during playing of the game.

The present invention is an improvement over such card game methods. The invention makes the game even more unpredictable and further raises the level of excitement during playing of the game.

The inventive method requires the use of at least one card that, if played by the penalty receiving player, transfers the penalty to the succeeding player. The method also includes the use of at least one card that, if played by the penalty receiving player, returns the penalty to the preceding player. Finally, the method includes the use of at least one card that, if played by the penalty receiving player, cancels the penalty.

SUMMARY OF THE INVENTION

The present invention relates to an improved card game method using a plurality of cards for successive play by a plurality of players. The method includes the use of at least one penalty card requiring a penalty receiving player to take a predetermined number of cards from a reserve card supply. One improvement is the use of at least one card that, if played by the penalty receiving player, transfers the penalty required by the penalty card to the succeeding player. Another improvement is the use of at least one card that, if played by the penalty receiving player, returns the penalty required by the penalty card to the preceding player. A final improvement is the use of at least one card that, if played by the penalty receiving player, cancels the penalty required by the penalty card.

BRIEF DESCRIPTION OF THE DRAWINGS

For a more complete understanding of the present invention and the advantages thereof, reference is now made to the following description taken in conjunction with the accompanying drawings.

Referring to the drawings.

DETAILED DESCRIPTION OF THE DRAWINGS

Figure 1:
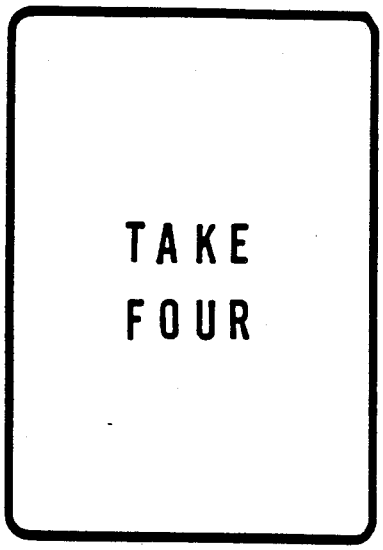
FIG. 1 PRIOR ART
FIG. 1 is a representation of a prior art playing card for use in a game that requires a receiving player to take a predetermined number of cards from a reserve card supply as a penalty.

There are many methods of playing a card game in which a plurality of players are each dealt a particular number of cards from a deck with the remaining cards forming a reserve or draw pile from which players may draw cards as required. In such decks, the top card of the draw pile is sometimes turned face up so that the player who is to begin the play can play on that card. Some decks, such as UNO®, a copyrighted deck of International Games, Inc., provide penalty cards such as shown in FIG. 1 that, when played by one player, require the succeeding player to take a number of cards from the draw pile as a penalty. There is no way to avoid the penalty and the penalty receiving player must draw the number of cards designated by the penalty card.

Such a game, where penalty cards are played, is made much more exciting an unpredictable by providing a method for cancelling or deflecting the penalty. The card deck of the invention includes one or more cards, such as that shown in FIG. 2, that is played by the penalty receiving player, cancels the penalty required by the penalty card. Thus, if a penalty card such as "TAKE FOUR" is played, the penalty receiving player, if he has in his hand the card with the indicia shown in FIG. 2, can play it and cancel the penalty required by the penalty card. The "CANCEL" card may have any desired indicia such as a name that could be, for example only, "EUREKA."

Figure 3:
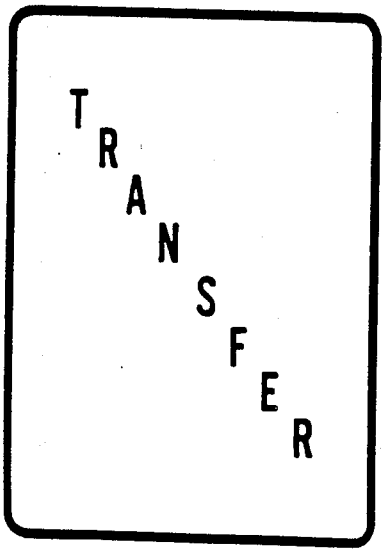
FIG. 3 is a representation of a card that, if played by the receiving penalty player, transfers the penaltty required by a penalty card to the succeeding player.

It is still a more exciting and unpredictable method of play if one or more cards having indicia as illustrated in FIG. 3 are available in the deck of cards. In that case, if a "TAKE FOUR" card is played and the penalty receiving player has the "TRANSFER" card shown in FIG. 3, he can "TRANSFER" the penalty required by the penalty card to the succeeding player. In other words, he "slides" the penalty to the next player. The "TRANSFER" card could have any desired indicia or name such as, for example only, "SLIDE."

Figure 4:
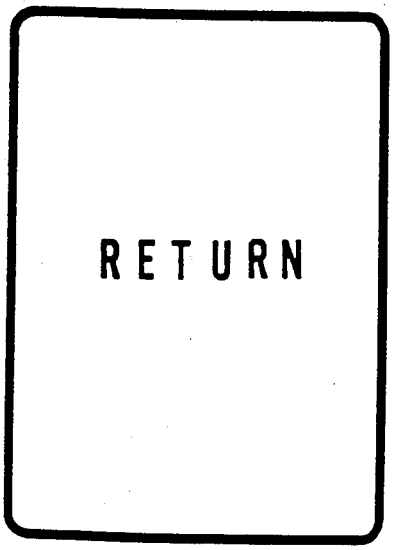
FIG. 4 is a representation of a card that, if played by the receiving penalty player, returns the penalty required by a penalty card to the preceding player.

In addition, the method of playing the card game is even more unpredictable and exciting if one or more cards having indicia of the type shown in FIG. 4 are included in the deck. Then, if a "TAKE FOUR" card is played, the penalty receiving player, if he has one of the cards shown in FIG. 4 in his hand, can play it on the penalty card and return the penalty to the player who played the penalty card. Such card could have any desired indicia or name such as, for example only, "BOOMERANG."

Figure 2:
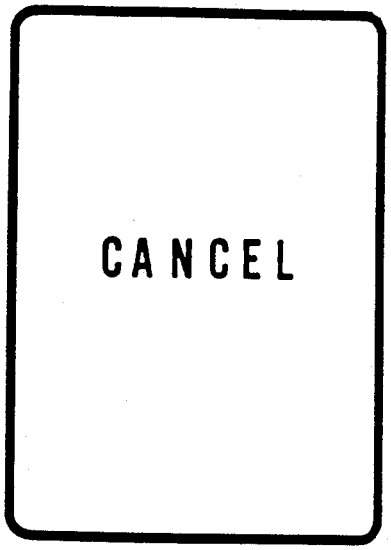
FIG. 2 is a representation of a card that, if played by the penalty receiving player, cancels the penalty required by a penalty card.

Thus, with the use of the three cards having the indicia shown in FIGS. 2, 3, and 4, a method of playing a card game involving penalty cards can be made much more exciting, interesting, and unpredictable. As indicated, the particular name or design of the card is not critical and the designs or indicia shown in FIGS. 2, 3 and 4 are for purposes of example only. In addition, one or more of each of the cards can be used in a deck of cards as desired to give the game maximum interest and unpredictability.

Thus, there has been disclosed an improved method of playing a card game using a card deck of the type having penalty cards requiring the penalty receiving player to take a predetermined number of cards from a reserve card supply. The improvement comprises the use of one or more cards that either cancel the penalty, transfer it to the preceding player, or return it to the succeeding player.

The invention has been described in connection with a preferred embodiment. This description is not intended to limit the scope of the invention to the particular form set forth, but, on the contrary, it is intended to cover such alternatives, modifications, and equivalents as may be included within the spirit and scope of the invention as defined in the appended claims.

I claim:

1. A method of increasing the uncertainty and excitement in the playing of a card game with a card deck having a plurality of cards for play by a plurality of players, said cards including at least one penalty card which, when played by a first player, requires a second player to take a predetermined number of cards from a reserve card supply as a penalty, the improvement comprising the steps of:

designating at least one card in the deck having identifying indicia thereon which, when played by the second player, allows the second player to escape the penalty by transferring the penalty required by the penalty card to the succeeding player thereby requiring the succeeding player to take the predetermined number of cards;

designating at least one card in the deck having identifying indicia thereon which, when played by the second player, allows the second player to escape the penalty by returning the penalty required by the penalty card to the preceding player thereby requiring the preceding player to take the predetermined number of cards; and designating at least one card in the deck having identifying indicia thereon which, when played by the second player, allows the second player to escape the penalty by cancelling the penalty required by the penalty card such that no player is required to take the predetermined number of cards.

2. A method of increasing the uncertainty and excitement in the playing of a card game with a card deck having a plurality of cards for play by a plurality of players, said cards including at least one penalty card which, when played by a first player, requires a second player to take a predetermined number of cards from a reserve card supply, the improvement comprising the step of designating at least one card in the deck having identifying indicia thereon which, when played by the second player, allows the second player to escape the penalty by transferring the penalty required by the penalty card to the succeeding player thereby requiring the succeeding player to take the predetermined number of cards.

3. A method of increasing the uncertainty and excitement in the playing of a card game with a card deck having a plurality of cards for play by a plurality of players, said cards including at least one penalty card which, when played by a first player, requires a second player to take a predetermined number of cards from a reserve card supply, the improvement comprising the step of designating at least one card in the deck having identifying indicia thereon which, when played by the second player, allows the second player to escape the penalty by returning the penalty required by the penalty card to the preceding player thereby requiring the preceding player to take the predetermined number of cards.

4. A method of increasing the uncertainty and excitement in the playing of a card game with a card deck having a plurality of cards for play by a plurality of players, said cards including at least one penalty card which, when played by a first player, requires a second player to take a predetermined number of cards from a reserve card supply, the improvement comprising the step of designating at least one card in the deck having identifying indicia thereon which, when played by the second player, allows the second player to escape the penalty by cancelling the penalty required by the penalty card such that no player is required to take the predetermined number of cards.

* * * * *